US006693614B2

(12) United States Patent
Kamiya et al.

(10) Patent No.: US 6,693,614 B2
(45) Date of Patent: Feb. 17, 2004

(54) LCD DEVICE

(75) Inventors: Takeo Kamiya, deceased, late of Kobe (JP), by Akihiko Miyazaki, legal representative; Masaru Yasui, Kobe (JP)

(73) Assignee: Koninklijke Philips Electronics N.V., Eindhoven (NL)

( * ) Notice: Subject to any disclaimer, the term of this patent is extended or adjusted under 35 U.S.C. 154(b) by 29 days.

(21) Appl. No.: 09/914,391

(22) PCT Filed: Dec. 20, 2000

(86) PCT No.: PCT/EP00/12983

§ 371 (c)(1),
(2), (4) Date: Aug. 27, 2001

(87) PCT Pub. No.: WO01/48731

PCT Pub. Date: Jul. 5, 2001

(65) Prior Publication Data

US 2002/0135552 A1 Sep. 26, 2002

(30) Foreign Application Priority Data

Dec. 28, 1999 (JP) ..... 11-373156

(51) Int. Cl.[7] ..... G09G 3/36; G09G 5/00; G09G 5/10

(52) U.S. Cl. ..... 345/89; 345/211; 345/690

(58) Field of Search ..... 345/89, 690, 211

(56) References Cited

U.S. PATENT DOCUMENTS

| | | | | | |
|---|---|---|---|---|---|
| 5,504,933 | A | * | 4/1996 | Saito | 725/1 |
| 5,757,365 | A | * | 5/1998 | Ho | 345/212 |
| 5,952,991 | A | * | 9/1999 | Akiyama | 345/98 |
| 6,160,594 | A | * | 12/2000 | Hanami et al. | 349/34 |
| 6,339,422 | B1 | * | 1/2002 | Kuwajima et al. | 345/204 |

FOREIGN PATENT DOCUMENTS

| | | | |
|---|---|---|---|
| EP | 0790707 | * | 8/1997 |
| EP | 0852371 | * | 7/1998 |

* cited by examiner

*Primary Examiner*—Richard Hjerpe
*Assistant Examiner*—M. Fatahiyar

(57) ABSTRACT

The device has an LCD panel 6, a digital circuit 1 and an analog circuit 2 which generate display signals to be supplied to the LCD panel 6, and has functions of normal mode and stand-by mode in a status where electric power is supplied from a power source 5. In the normal mode, a multivalued display signal which can represent gradation levels is generated and supplied to the LCD panel 6, while in the stand-by mode, a binary display signal which does not represent gradation levels is generated and supplied to the LCD panel 6.

6 Claims, 2 Drawing Sheets

LCD DEVICE

DETAILED DESCRIPTION OF THE INVENTION

This invention relates to a display apparatus and more particularly to the display apparatus having a liquid crystal display (LCD) panel.

PRIOR ART

In the display apparatus having a transmissive type of LCD panel, a backlight system is used to illuminate the display image from a rear side of a LCD panel. In the transmissive type of LCD panel for a note-book type of personal computer and PDA (Portable Digital Apparatus), if operating means such as a key board, a mouse or the like is not operated after a lapse of a certain time, the power consumption is reduced because of transition to a stand-by mode (a sleep mode) to shut off the backlight and to shut off a display signal to the LCD panel. Specifically, since power consumption of the backlight is large, an effect of power reduction of transiting to a stand-by mode is remarkable.

PROBLEMS TO BE SOLVED BY THE INVENTION

However, power reduction has not been realized in a reflecting-type LCD panel effectively, because the backlight system is not used. A reflecting-type LCD is used in a portable phone which requires low power consumption. However, in the stand-by mode for an incoming wait, an incoming notice can not be displayed by shutting off the display signal to the LCD panel. Display means to indicate the incoming notice is required. Moreover, there is a case that only a present time is desired to display. For this purpose, in the display apparatus having the reflecting-type LCD panel without a backlight, there has been a problem of a tradeoff between more power reduction and a display with the minimum required.

The object of the invention is to provide a display apparatus capable of realizing more power reduction and capable of displaying the display with the minimum request.

To this end, the display device according to the invention comprises a display unit and display control means for generating the display signal to be supplied to the display unit, having functions of the usual mode and the stand-by mode in a state where electric power is supplied from a power source, wherein in the usual mode, the display control means generates a multivalued display signal which can represent gradation levels, while in the stand-by mode, the display control means generates a binary display signal which does not represent gradation levels.

Since the binary display signal is generated instead of the multivalued display signal, of which power consumption is large in the stand-by mode, more power reduction can be realized, and the display with the minimum required incoming notice and time indication can be displayed.

In the display device according to the invention, the display control means has a first circuit that generates the multivalued display signal and a second circuit that generates the binary display signal. In the stand-by mode, the display control means stops supply of the electric power to the first circuit and supplies the binary display signal generated by the second circuit to the display unit. According to this constitution, applying the electric power to a circuit with large power consumption is stopped and the display signal is generated by a circuit with less power consumption, whereby power reduction can be realized effectively, and a minimum display can be realized.

In the display device according to the invention, the first circuit includes a circuit to convert a plural-bits digital signal into an analog signal. According to this constitution, in the stand-by mode, the circuit with large power consumption is inactivated, whereby a large amount of power reduction becomes possible.

Moreover, in the display device according to the invention, the first circuit includes a circuit to convert a plural-bits digital signal into an analog signal and an amplification circuit to amplify the analog signal. According to this, constitution, the amplification circuit can be also inactivated, whereby a large amount of power reduction becomes possible.

Moreover, in the display device according to the invention, the display control means includes an amplification circuit having serially-connected two active elements. In the normal mode, the display control means supplies a multivalued display signal to the display unit through the two active elements in accordance with input of analog signal, while in the stand-by mode, the display control means supplies the binary display signal to the display unit through one of the two active elements. According to this constitution, the binary display signal is generated in a state where the electric power for the circuit is reduced by using the amplification circuit to generate the multivalued display signal, so that the addition of the circuit may not be required in order to generate the binary display signal.

Moreover, in the display device according to the invention, the display control means has plural digital circuits that generate plural-bits digital signals to generate the multivalued display signal, and in the stand-by mode, the display control means activates only one digital circuit that generates a particular 1-bit digital signal among the plural bits, and inactivates the other digital circuits. According to this constitution, power consumption can be reduced not only in the circuit to generate the multivalued display signal, but also in the circuit to generate the digital signal.

Moreover, in the display device according to the invention, the display unit is constituted by a reflective-type liquid crystal display unit, and the display control means supplies the display signal to a driving circuit of this liquid crystal display unit. According to this constitution, power consumption of batteries for the note type personal computer and PDA can be reduced, and the successive use time of the device can be extended inevitably.

EMBODIMENT OF THE INVENTION

FIG. 1 shows block diagrams for a part of a display device with a reflecting-type LCD panel according to the invention.

Referring to FIG. 1, an operation detection circuit 1, a digital circuit 2 as a first circuit, an analogous circuit 3 as a second circuit are connected with a power source 5 via a power source line 4, and a constant voltage VC is supplied thereto. The LCD panel (the display unit) 6 is connected with the power source 5 via a power source line 7 and a constant voltage VD is supplied thereto. When the time for no operation of the display device exceeds a predetermined time, the operation detection circuit 1 supplies STBY as a stand-by signal of Low-active to the digital circuit 2 and the analogous circuit 3 through a signal line 8 for the transition to a stand-by mode.

The digital circuit 2 is constituted by C-MOS IC to generate the digital signal for generating the display signal, which signal is supplied to the analogous circuit 3 through a signal line 9. The analogous circuit 3 generates the display signal in response to this digital signal, which display signal is supplied to a driving circuit of the LCD panel 6 through a signal line 10. The LCD panel 6 drives pixel electrodes by TFTs (thin film transistors) to display images.

TFT is the thin film transistor which is constituted by a gate located at a crossing point of matrix comprising a gate bus in a horizontal display direction and a source bus in a perpendicular display direction, the source and the drain, and a channel between the gate and the source. The channel is turned on by supplying a pulse signal to the gate bus under the condition that the display signal is supplied to the source bus and the display signal supplied to the source is applied to the pixel electrode which is connected with the drain. That is, the above-mentioned analogous circuit 3 constitutes a source driver circuit and generates the display signal every perpendicular scanning time of a plurality of source lines, which display signal is supplied to the LCD panel.

The digital circuit 2 and the analogous circuit 3 shown in FIG. 1 constitute the display control means which supplies the display signal to the source bus and FIG. 2 shows its circuit.

In FIG. 2, a D/A converter circuit 301 converts 6 bits of the digital signal into the analog signal. Six inputs of the D/A converter circuit 301 are connected with an output of one buffer circuit 201 corresponding to the most significant bit (MSB) and outputs of five AND circuits 202 to 206, respectively. Six bits of the digital signal for generating the analogous signal are supplied to an input of the buffer circuit 201 and inputs of the AND circuits 202 to 206. Moreover, a signal line 8 of STBY from the operation detection circuit 1 shown in FIG. 1 is connected with other inputs of the AND circuits 202 to 206. This signal line 8 is connected with the power source line 4 through a pull-up resistor 207.

Moreover, a signal line 11 of an AC signal POL is connected with the D/A converter circuit 301. POL acts to reverse the driving voltage of the liquid crystal to a plus or a minus voltage. For example, it is turned into a plus writing mode when a common electrode of TFT is zero volt, and the D/A converter circuit is controlled such that white becomes zero volt and black becomes 5 volt. It is turned into a minus writing mode when a common electrode of TFT is 5 volt, and the D/A converter circuit is controlled such that white becomes 5 volt and black becomes zero volt.

Since STBY is a high level in a normal mode, an AND circuits 202 to 206 turn into an active condition (an enabled condition). For this reason, six bits of the digital signal from the buffer circuit 201 and the AND circuits 202 to 206 are supplied to the D/A converter circuit 301. On the other hand, since STBY is in Low-level in the stand-by mode, the AND circuits 202 to 206 become an inactive condition (a disenabled condition). For this reason, five bits of the digital signal from the AND circuit 202 to 206 are not supplied, and only one MSB bit of the digital signal from the buffer circuit 201 is supplied.

An output of D/A converter circuit 301 is connected with an input of an amplification circuit 302. Both a power source terminal of the D/A converter circuit 301 and a power source terminal of the amplification circuit 302 are connected with the power source line 4 through a switch circuit 303 formed by an analogous switch. A control terminal of this switch circuit 303 is connected with the signal line 8 of STBY. Moreover, an output of the amplification circuit 302 is connected with an output terminal 305 through the switch circuit 304, and a control terminal of the switch circuit 304 is connected with the signal line 8.

For this reason, the switch circuit 303 turns into the active condition in the case that STBY is in the normal mode of the High-level, and electric power is supplied to the D/A converter circuit 301 and the amplification circuit 302, thereby to turn into an ON condition in which a bias electric current flows. Six bits of the digital signal of the D/A converter circuit 301 is converted into the analogous signal, and is amplified by the amplification circuit 302, and the multivalued display signal for gradation from the output terminal 305 is supplied to the source bus of the LCD panel.

The output terminal 305 is connected with the power source line 4 through the switch circuit 306, and is connected with a ground line through a switch circuit 307. An output of the AND circuit 208 is connected to the control terminal of the switch circuit 306, and a control terminal of the switch circuit 307 is connected with an output of the AND circuit 209. A signal line 12 of STBY reversed by an inverter circuit 210 is connected with each one of inputs of these AND circuits 208 and 209.

For this reason, since each one of the inputs of the AND circuits 208 and 209 receives a low signal in the case that STBY is in the normal mode of the High-level, outputs of the AND circuits 208 and 209 turns into Low-level regardless of a level of other inputs. As a result, the switch circuits 306 and 307 turn into an OFF condition. Therefore, the power source line 4 and the ground line are shut off from an output terminal 305, and can not influence on the display signal from the amplification circuit 302.

In the case that STBY is in the stand-by mode of the Low-level, the switch circuit 303 turns into the OFF condition, and electric power is not supplied to the D/A converter circuit 301 and the amplification circuit 302, and turns into an inactive condition in which a bias current does not flow. Moreover, the switch circuit 304 turns into OFF, and output of the amplification circuit 302 is shut off from the output terminal 305.

Furthermore, in this stand-by mode, the high signal is given by the signal line 12 to input of each of the AND circuits 208 and 209 respectively. For this reason, the AND circuits 208 and 209 turn into the active conditions. An output of an exclusive OR circuit 211 is connected with the other input of the AND circuit 208, and an output of the exclusive OR circuit 212 is connected with the other input of the AND circuit 209.

A signal line of POL is connected with each one of inputs of these exclusive OR circuits 211 and 212. Moreover, an output of the buffer circuit 201 is connected with the other input of the exclusive OR circuit 211, as well as the signal reversed by the inverter circuit 213 is supplied to the other input of the exclusive OR circuit 212.

For this reason, the switch circuit 306 turns into ON only in the case where one bit of MSB output of the buffer circuit 201 is HIGH-level, and the switch circuit 307 turns into ON only in the case where MSB is Low-level, when POL is set at Low-level in the stand-by mode, for example. Therefore, the binary display signal from the output terminal 305 is supplied to the source bus of the LCD panel in response to MSB.

As described above, since the binary display signal is generated instead of generating the multivalued display signal, the power consumption in these circuits is reduced in the stand-by mode by stopping a supply of electric power to the D/A converter circuit 301 and the amplification circuit 302 to turn into the inactive condition. Especially, since the bias current for generating the multivalued display signal in these circuits is large, the effective power consumption becomes possible by turning these circuits into the inactive condition to make the bias current zero.

Incidentally, the power consumption Pd is represented by the following formula in C-MOS IC in general.

$$Pd=CVf.$$

In this formula, a reference symbol C is a load capacitance of the signal line, a reference symbol V is an amplitude of the signal (approximately voltage VC in the case of FIG. 1), and a reference symbol "f" is a repetitive frequency of zero and 1 (the rate of change of voltage dV/dt). The more the number of the signal line becomes, the larger the load capacitance C becomes. For example, in order to generate the multivalued display signal for RGB color display, the eighteen signal lines in total are connected between the outputs of the digital circuit and the inputs of the D/A converter circuit, because six bits of the digital signal is required every each color.

Since only each one MSB bit of each six bits in RGB is used, and the other five bits are fixed into 0 or 1 (the inactive condition), the frequency "f" in the fifteen signal lines is turned into zero in the stand-by mode. Supposing that the value of C and the value of V in each eighteen signal lines are the approximately same, the power consumption in the digital circuit can be reduced up to approximately one sixth, excluding power consumption due to a sampling clock or the like.

According to this constitution, the power consumption can be reduced in not only the AD converter circuit 301 and the amplification circuit 302 but also the AND circuits 202 to 206.

In the constitution according to the other embodiment of the invention, the D/A converter circuit is connected with the power source line through the switch circuit, and it becomes the active condition at the normal mode and becomes the inactive condition at the stand-by mode. The amplification circuit is connected with the power source line directly and is in the active condition at all the time.

In an equivalent circuit of an operational amplifier such as the amplification circuit 302 in FIG. 2, the output stage thereof is constituted that an NPN type transistor is connected with a PNP type transistor in form of totem pole type. For this reason, it is possible to generate the binary display signal and to supply to the source bus of the LCD panel in the stand-by mode by controlling the output stage with one bit digital signal appropriately, even without using the switch circuits 306 and 307 shown in FIG. 2. In order to generate the binary display signal, the additional switch circuits 306 and 307 in FIG. 2 and other circuit are not required.

Moreover, the LCD apparatus are used to explain in the described-above embodiment, however, this invention can not be necessarily limited to an application of the LCD apparatus. This invention can be applied to a plasma display apparatus, an electroluminescence display apparatus, and display apparatuses of other kinds, for example.

According to this invention, the effective power reduction can be realized, while minimum required incoming notice indication and present time indication can be displayed, since the multivalued display signal is generated in the usual mode, and the binary display signal is generated in the stand-by mode.

DESCRIPTION OF REFERENCE NUMERALS

Figure 1:
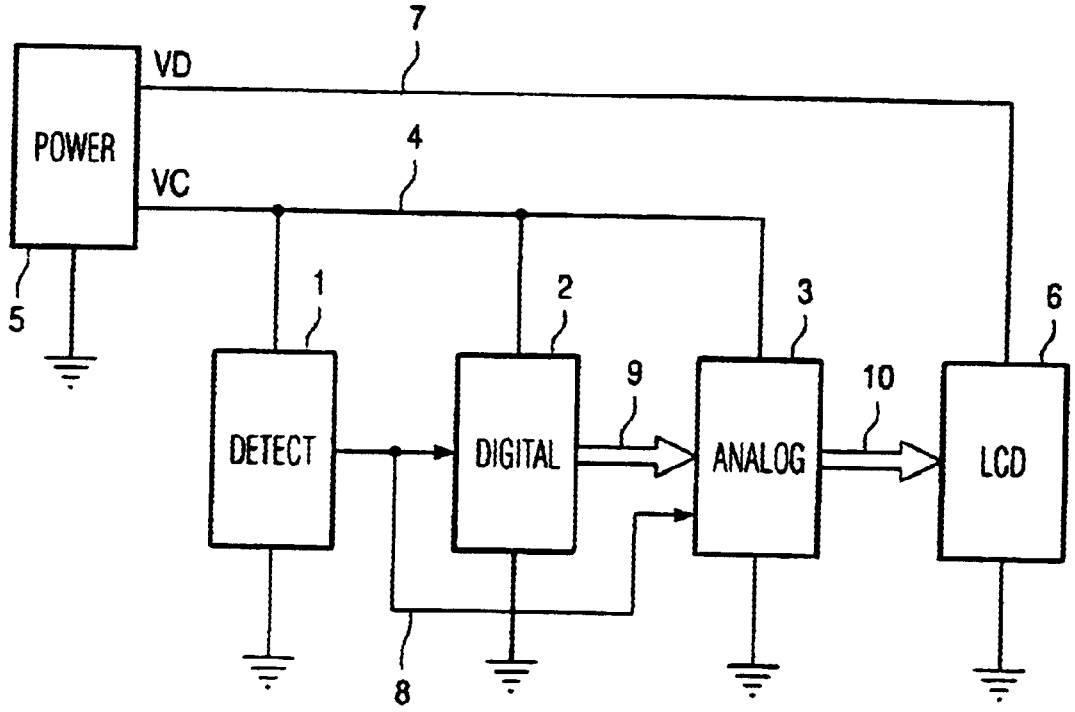
FIG. 1 is a block diagram showing a part of a system in a display device with a reflecting-type LCD panel according to the invention□
Figure 2:
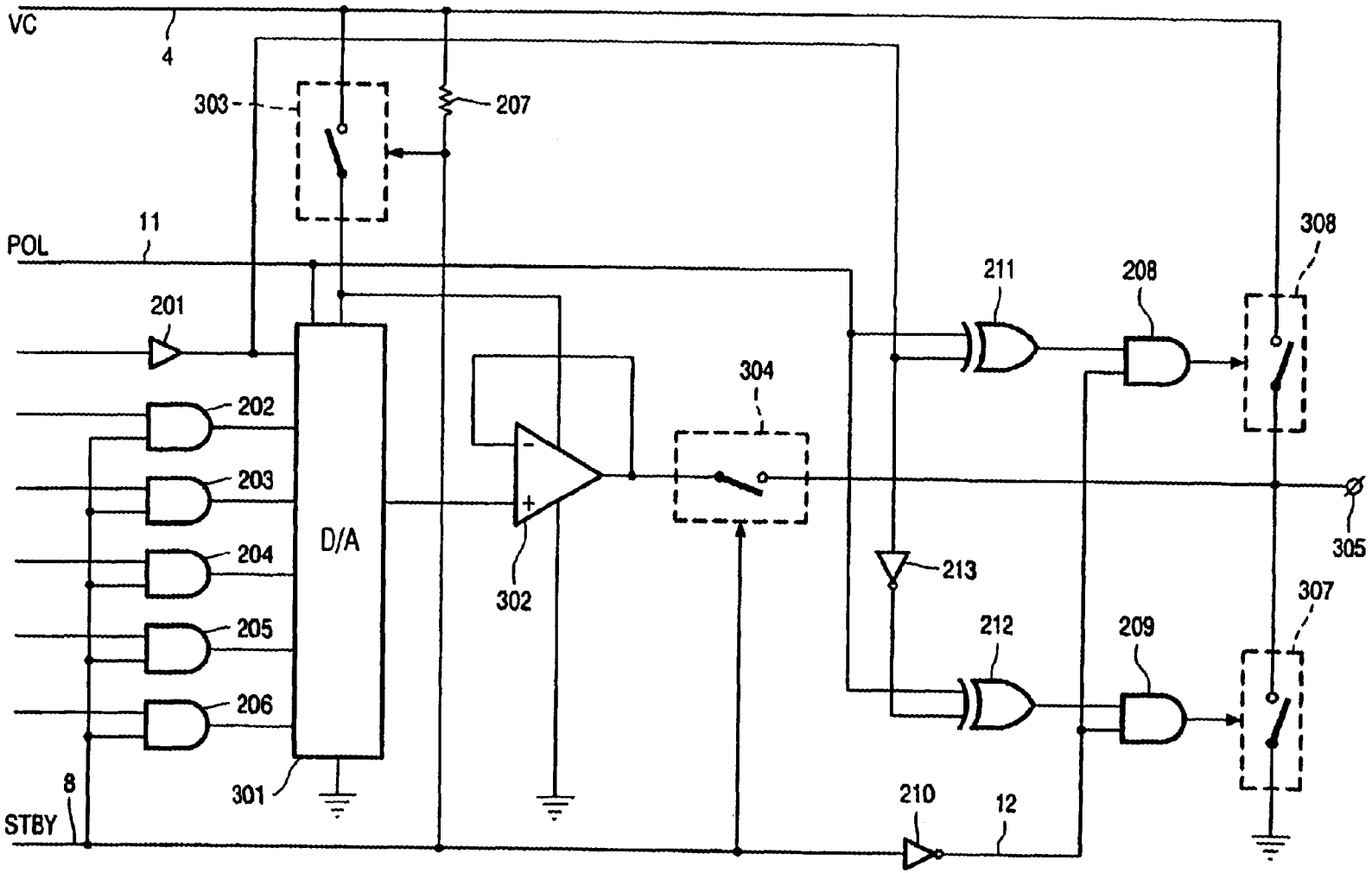
FIG. 2 is a circuit diagram of the digital circuit and the analogous circuit in FIG. 1.

1 . . . operation detection circuit
2 . . . digital circuit
3 . . . analog circuit
4 . . . power source line
5 . . . power source
6 . . . LCD panel
8 . . . STBY signal line
11 . . . alternating signal line
12 . . . inverse STBY signal line
201 . . . buffer circuit
202–206, 208, 209 . . . AND circuit
207 . . . pull-up resistor
210, 213 . . . inverter circuit
211, 212 . . . exclusive OR circuit
301 . . . D/A converter circuit
302 . . . amplification circuit
307 . . . switch circuit
305 . . . output terminal

What is claimed is:

1. A display device comprising:

a display unit and display control means for generating a display signal to be supplied to the display unit, having functions of normal mode and stand-by mode in a status where electric power is supplied from a power source, wherein:

in said normal mode, said display control means generates a multivalued display signal which can represent gradation levels, while in said stand-by mode, said display control means generates a binary display signal which does not represent gradation levels, and said display control means includes:

a first circuit to generate said multivalued display signal and a second circuit to generate said binary display signal, and in said stand-by mode, said display control means:

stops supply of the electric power to said first circuit, continues supply of the electric power to said second circuit, and supplies said binary display signal generated by said second circuit to said display unit.

2. The display device as claimed in claim 1, wherein said first circuit includes a circuit to convert a plural-bits digital signal into an analog signal.

3. The display device as claimed in claim 1, wherein said first circuit includes a circuit to convert a plural-bits digital signal into an analog signal and an amplification circuit to amplify the analog signal.

4. A display device comprising:

a display unit and display control means for generating a display signal to be supplied to the display unit, having functions of normal mode and stand-by mode in a status where electric power is supplied from a power source, wherein:

in said normal mode, said display control means generates a multivalued display signal which can represent gradation levels, while in said stand-by mode, said display control means generates a binary display signal which does not represent gradation levels, and said display control means includes an amplification circuit having serially-connected two active elements, and in said normal mode, said display control means supplies said multivalued display signal to said display unit through said two active elements, while in said stand-by mode, said display control means supplies said binary display signal to said display unit through one of the two active elements.

5. A display device comprising:

a display unit and display control means for generating a display signal to be supplied to the display unit, having functions of normal mode and stand-by mode in a status where electric power is supplied from a power source, wherein:

in said normal mode, said display control means generates a multivalued display signal which can represent gradation levels, while in said stand-by mode, said display control means generates a binary display signal which does not represent gradation levels, and said display control means has plural digital circuits that generate plural-bits digital signals to generate said multivalued display signal, and in said stand-by mode, said display control means activates only one digital circuit that generates a particular 1-bit digital signal among said plural bits, and inactivates the other digital circuits.

6. The display device as claimed in claim 1, wherein said display unit has a reflective-type liquid crystal display unit, and wherein said display control means supplies said display signal to a driving circuit of the liquid crystal display unit.

* * * * *